United States Patent [19]

Kasper et al.

[11] Patent Number: 5,030,257

[45] Date of Patent: Jul. 9, 1991

[54] SEPARATOR FOR A VACUUM CLEANER SYSTEM

[75] Inventors: Gary A. Kasper; Roy O. Erickson; Dean R. Rohn; Steven R. Selewski; Craig R. Cummins, all of Cadillac, Mich.

[73] Assignee: Rexair, Inc., Cadillac, Mich.

[21] Appl. No.: 423,021

[22] Filed: Oct. 18, 1989

[51] Int. Cl.[5] ..... B01D 47/00

[52] U.S. Cl. ..... 55/248; 15/353; 55/257.4; 55/472

[58] Field of Search ..... 15/353; 55/248, 257.4, 55/276, 470, 472

[56] References Cited

U.S. PATENT DOCUMENTS

| | | | |
|---|---|---|---|
| 1,101,558 | 6/1914 | Maxim | 55/320 |
| 1,539,480 | 5/1925 | Hawle | 55/1 |
| 1,878,052 | 9/1932 | Wilson et al. | 55/452 |
| 2,102,353 | 12/1937 | Brock | 55/472 |
| 2,221,572 | 11/1940 | Brock et al. | 55/248 |
| 2,233,167 | 2/1941 | Holm-Hansen | 15/353 |
| 2,608,268 | 8/1952 | Gerber | 55/472 |
| 2,909,800 | 10/1959 | Grindle et al. | 15/353 |
| 2,945,553 | 7/1960 | Brock | 55/248 |
| 3,065,489 | 11/1962 | Wright | 15/353 |
| 3,269,097 | 8/1966 | German | 55/337 |
| 3,292,347 | 12/1966 | Hodgkinson | 55/472 |
| 4,138,761 | 2/1979 | Nauta | 15/353 |
| 4,172,710 | 10/1979 | van der Molen | 15/353 |
| 4,231,133 | 11/1980 | Probost | 15/300 A |
| 4,547,206 | 10/1985 | Sovis et al. | 15/353 |
| 4,549,329 | 10/1985 | St. Clair | 15/353 |
| 4,640,697 | 2/1987 | Erickson, Jr. | 55/248 |
| 4,673,422 | 6/1987 | Tidwell | 55/248 |
| 4,693,734 | 9/1987 | Erickson, Jr. | 55/248 |

*Primary Examiner*—Jay H. Woo
*Assistant Examiner*—C. Scott Bushey
*Attorney, Agent, or Firm*—Harness, Dickey & Pierce

[57] ABSTRACT

A separator for use in connection with a liquid bath-type vacuum cleaner system. The separator includes an annular, cup-like housing adapted to rotate axially about its vertical axis for generating a centrifugal force to be applied to intake air therein; and a plurality of intake/exhaust slots formed in the housing for enabling dust and dirt particulates entrained in the intake air and liquid particulates from a liquid bath to be drawn into an interior area of the housing and coalesce therein, whereby the coalesced particulates are subjected to centrifugal force and are thereby separated from the intake air. The intake/exhaust slots further enable the coalesced particulates to be forcibly expelled from the interior area of the housing therethrough as they are forced radially outwards by the centrifugal force generated by the rapid, axial rotation of the housing.

36 Claims, 6 Drawing Sheets

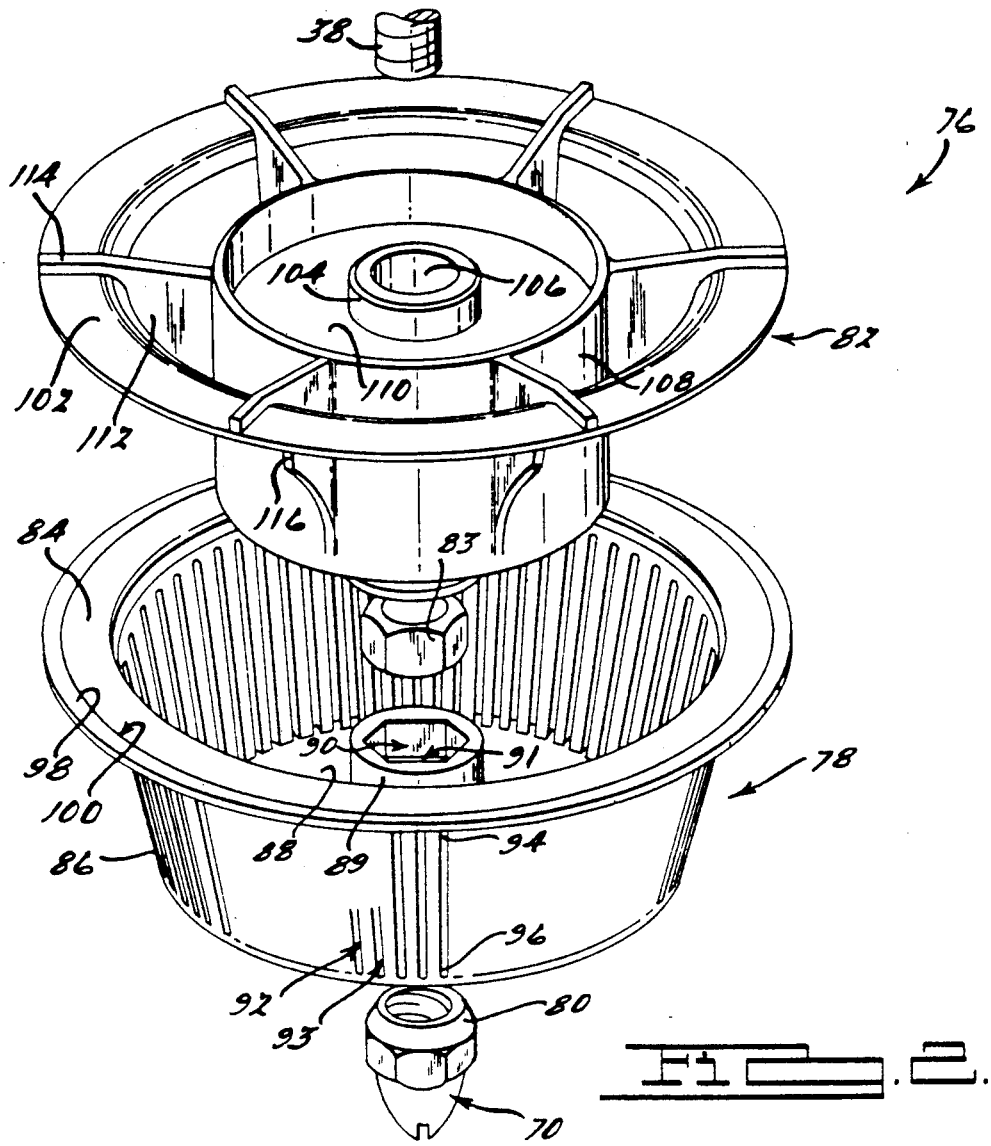
FIG. 2.
FIG. 3.
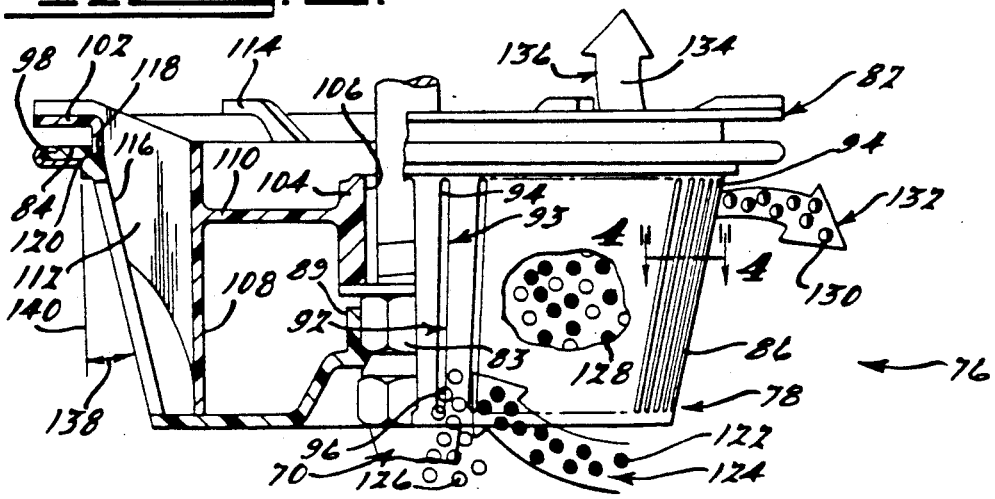

SEPARATOR FOR A VACUUM CLEANER SYSTEM

BACKGROUND OF THE INVENTION

1. Technical Field

This invention relates to vacuum cleaning devices and, more particularly, to an improved separator for use in conjunction with liquid bath type vacuum cleaners.

2. Discussion

Vacuum cleaners of various designs are used in residential and commercial settings for cleaning purposes. These appliances develop suction to create airflow which picks up large and small dust particulates from a surface being cleaned. These particulates are then separated from the air within the vacuum cleaner for later disposal.

One type of vacuum cleaner is a canister type which has a relatively stationary canister which is connected to a moveable wand by a flexible connecting hose. One particular design of canister type vacuum cleaners is known as a liquid bath type. This type of vacuum cleaner directs incoming air and particulates into contact with a liquid bath which is typically water, which in turn absorbs particulate matter. Liquid bath type cleaners in general have a significant advantage in that their filtration mechanism uses readily available water, thereby eliminating the need for replaceable filters. In addition, these machines provide a room humidifying effect since some of the water in the liquid bath becomes dissolved in the air discharged from the vacuum cleaner during use.

Numerous designs of liquid bath type vacuum cleaners are presently known. The following U.S. Patents, the disclosures of which are hereby incorporated by reference, and all of which are assigned to the assignee of the present invention, relate to various improvements in liquid bath type vacuum cleaner: U.S. Pat. Nos. 2,102,353; 2,221,572; 2,886,127; and 2,945,553.

Although devices constructed in accordance with the above mentioned issued patents perform satisfactorily, designers are constantly seeking to reduce the amount of fine dust and dirt particulates that escape entrapment in the liquid bath type filter and which are expelled by the vacuum cleaner back into the ambient environment. In this regard, designers have been striving to improve the operation of a part of such vacuum cleaners which is generally known as the separator. Up until the present, the separator of a vacuum cleaner has functioned to provide a first stage of filtration by impeding the flow of medium and large size dust and dirt particles, which have not been trapped in the liquid bath, through the vacuum cleaner and back into the ambient enviroment.

The efficacy of the separator could be further enhanced, however, if the separator was operable to provide a second stage of filtration to remove the fine dust and dirt particulates which enter it, and which would otherwise normally be exhausted into the ambient environment. One method of accomplishing this would be by employing a method of separation known generally as centrifugation. Briefly, centrifugation involves the application of centrifugal force to an air mass entrained with liquid or solid particulate matter. The centrifugal force is typically produced by drawing the contaminated air mass into an annular chamber and spinning the chamber and contaminated air mass therein radially at a high angular velocity. The magnitude of centrifugal force created, which may be on the order of 10,000 Gs or more depending on the angular velocity of the chamber, forces the liquid and the contaminants, i.e., dust and dirt particulates, radially outward toward the outer wall of the chamber where they are exhausted through openings in the chamber wall, thereby leaving a clean air mass within the rotating chamber. If applied to a separator of a vacuum cleaner, centrifugation could be used to help filter out the smaller dust and dirt particulates which would otherwise pass through the vacuum cleaner and back into the ambient environment.

To still further enhance the filtering of small dust and dirt particles which have escaped being trapped in the liquid bath filter and which have entered the separator, it has been found that if microscopic liquid particulates, or droplets, from the liquid bath are also drawn into the separator and allowed to coalesce with the dust and dirt particulates entrained in the intake air, a marked improvement will occur in the amount of dust and dirt particulates removed by the separator. It has further been found that this improvement can be achieved with negligible adverse effects on other aspects of the vacuum system, such as the suction-like air flow through the system.

In view of the foregoing, it is a principal object of the present invention to provide an improved separator for a vacuum cleaner for more effectively separating fine dust and dirt particulates entrained in intake air from the intake air.

It is a further object of the present invention to provide an improved separator operable to centrifuge small dust and dirt particulate matter from intake air before the intake air is expelled back into the ambient environment.

It is still a further object of the present invention to provide an improved separator operable to allow liquid particulates to be drawn therein and coalesce with fine dust and dirt particulates entrained in intake air.

It is yet another object of the present invention to provide an improved separator operable to remove coalescing liquid, dust and dirt particulates from within the separator, thereby producing a clean air mass which may be expelled back into the ambient environment.

It is still another object of the present invention to provide an improved separator capable of removing coalescing liquid, dust and dirt particulates entrained in intaked air, which produces only negligible adverse effects on the suction-like force of, and airflow through, a vacuum system.

SUMMARY OF THE INVENTION

The above objects of the present invention are provided by a new and improved separator operable to allow microscopic water particulates, or droplets, to be drawn into the separator and mixed with dust and dirt particles entrained in air also intaked into the separator. In a first preferred embodiment, the separator comprises annular, cup-like housing means adapted to rotate axially about its vertical axis for generating centrifugal force to be applied to liquid, dust and dirt particulates entrained in the intake air; intake means for allowing air containing dust and dirt particulates along with microscopic liquid particulates to enter an interior area of the housing means and coalesce; and exhaust means for allowing the coalescing particulates to be expelled from the interior area of the housing means as they are centrifuged towards and through the exhaust means during rapid, axial rotation of the housing means.

In a second preferred embodiment the separator includes annular housing means adapted to rotate axially for generating centrifugal force to be applied to the intake liquid and the air containing dust and dirt particulates; intake means for allowing the liquid and the air containing dust and dirt particulates to enter the annular housing means and coalesce therein; exhaust means for allowing the coalescing particulates to be expelled from the annular housing means; and a removable lower support cover for providing additional structural support to the annular housing means and for blocking the intake of the liquid and the air containing dust and dirt particulates through a lower portion of the annular housing means.

In a third preferred embodiment the separator comprises an annular, cup-like housing means having intake means disposed on a bottom portion of the cup-like housing means. The intake means is operable to allow the liquid and the dust and dirt particulates entrained in air intaked into the cup-like housing means to coalesce therein. The cup-like housing means operates through centrifugal force developed by axial rotation about its vertical axis to force the particulates outwardly through exhaust means disposed on a side portion of the cup-like housing means.

In a fourth preferred embodiment the separator includes a cup-like housing means having an angled bottom portion for increasing the centrifugal force therein, and an intake means disposed on the angled bottom portion for allowing the liquid and the air containing the dust and dirt particulates to be passed into the cup-like housing means. The angled bottom portion further helps to control the amount of particulates intaked into the separator.

A fifth preferred embodiment includes a cup-like housing means having a curved bottom portion with intake means disposed on the curved bottom portion. The curved bottom portion also helps to control the amount of particulates intaked into the cup-like housing means.

In each of the above embodiments, a spider having a plurality of vanes may be incorporated. The spider may be removably attached to the housing means and provides additional structural support thereto. The spider also helps to increase the centrifugal force applied to the liquid and the air containing dust and dirt particulates intaked into the housing means and to provide a labyrinth seal with the separator to prevent dust and dirt particulates from entering the area between the separator and the spider, and thereby circumventing the operation of the intake means.

BRIEF DESCRIPTION OF THE DRAWINGS

The various advantages of the present invention will become apparent to one skilled in the art upon reading the following specification and subjoined claims, and by reference to the drawings in which:

FIG. 2 is an exploded perspective view of a first preferred embodiment of the present invention showing the spider, the cup-like housing, the intake/exhaust slots in the cup-like housing, a portion of a motor shaft for providing axial rotation of the spider and the cup-like housing, and the motorshaft nut;

FIG. 3 is a side elevational view partially in cross-section of the preferred embodiment of the separator and the spider in assembled form;

DETAILED DESCRIPTION OF THE PREFERRED EMBODIMENTS

Figure 1:
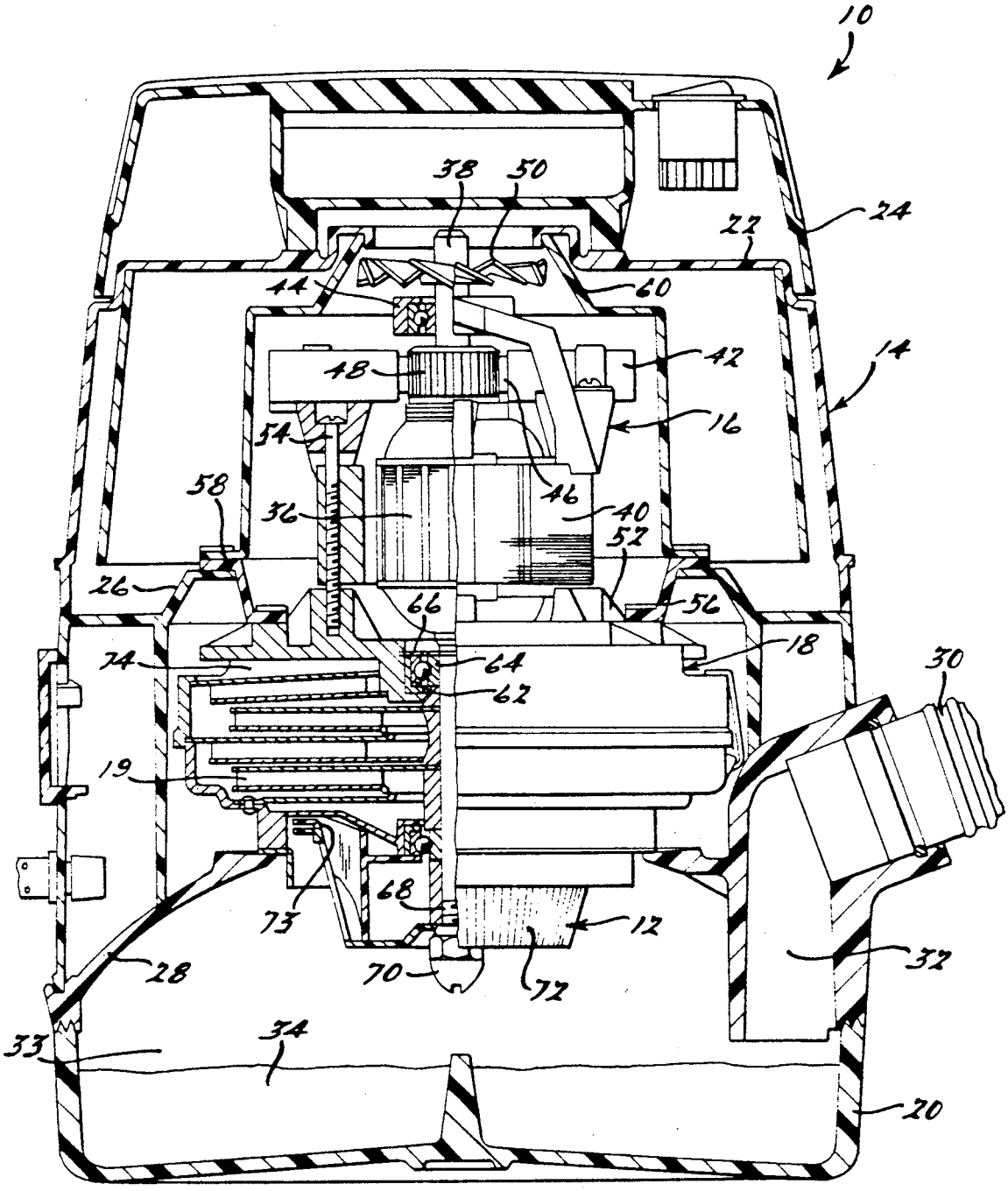
FIG. 1 is a vertical sectional view partially fragmented of a vacuum cleaner within which the separator may be used, including a partially fragmented side elevational view of the separator showing it as it may be typically connected therein.

In FIG. 1, there is shown a vertical sectional partially fragmented view of a typical vacuum cleaner system 10 in which a separator 12 of the present invention, as is also shown in a partially fragmented side elevational view, may be used. The vacuum cleaner 10 principally comprises a housing assembly 14, a motor assembly 16, a blower assembly 18, and a separator 12.

The housing assembly 14 includes a lower water pan 20, a cap 22 and a cap cover 24. Preferably, the housing assembly 14 is easily removable from the water pan 20 to enable the convenient removal and replacement of liquid therein. The motor assembly 16 and the blower assembly 18 are generally centrally supported within the housing assembly 14. The motor assembly 16 and the blower assembly 18 are supported within the housing assembly 14 by providing a pair of ring-shaped support members 26 and 28.

A vacuum hose 30 is also shown attached to an inlet port 32. The inlet port 32 opens into a lower chamber area 33 wherein a water or other liquid-type bath 34 is contained in the lower water pan 20.

The motor assembly 16 provides motive power for operation of a fan assembly 19 of the blower assembly 18. The motor assembly 16 includes a central rotating armature 36 encircling and connected to a motor shaft 38, which extends downwardly into the blower assembly 18. Surrounding the armature assembly 36 is a field assembly 40. A combination bearing retainer and brush holder 42 is provided which retains an upper bearing assembly 44 and supports a pair of brushes 46 which communicate electrical energy to the armature 36 through a commutator 48. The motor assembly 16 is of the type generally known as a universal motor which has the desirable operating characteristics for use in conjunction with vacuum cleaners.

An axial flow motor fan 50 is attached to the upper portion of the motor shaft 38 and generates air flow for cooling the motor assembly 16. The field assembly 40 and the bearing retainer and brush holder 42 are fixed through attachment to a motor base 52 by using threaded fasteners 54. The motor base 52 is in turn connected to a web 56 by employing a clamping ring 58. The direction of air flow past the motor assembly 16 generated by the fan 50 is controlled by providing a baffle 60 which generally encircles and encloses the motor assembly 16. The motor base 52 further defines a bearing retainer pocket 62 which receives a middle bearing assembly 64, which is secured by a push-in type clip 66.

The separator 12 itself is removably attached at a lower, threaded end 68 of the motor shaft 38 by an acorn nut 70. The separator 12 further includes a plurality of slots 72 for allowing intake air to be drawn and a removable spider 73 to provide additional structural support to the separator 12 and to help generate centrifugal force within the separator 12.

In operation, the motor 16 of the vacuum cleaner 10 operates to provide a motive force to the motor shaft 38 to rotate the fan assembly 19 of the blower 18 and the separator 12 rapidly about a central axis. The blower 18 operates to create a strong, suction force (vacuum) to draw air entrained with dust and dirt particulates in through the vacuum hose 30 and the inlet port 32 and into contact with the liquid bath filter 34. The liquid bath filter 34, which may employ one or more of a variety of liquid agents but preferably comprises water, operates to trap the majority of dust and dirt particulates intaked into lower chamber 33. The remaining dust and dirt particulates, which will be mostly microscopic in size, will be drawn by the blower 18 up into the separator 12 through the slots 72.

The separator 12 operates to separate the dust and dirt particulates from the intaked air by centrifugal force (i.e., "centrifugation") generated as a result of its rapid, axial rotation. The centrifugal force also operates to forcibly exhaust the particulates outwardly from the separator 12. Eventually, many of the dust and dirt particulates that initially escaped entrapment in the liquid bath filter 34 will be trapped therein, and the particulates which are not will be drawn upwardly again into the separator 12 for further separation. The clean air mass within the separator 12, which will exist after the dust and dirt particulates are removed, will then be drawn upwardly through the blower 18 and expelled into the ambient environment through air chamber 74.

The foregoing has been intended as a general description only of the internal operation of a vacuum cleaner in which the present invention may be used. More specific details of the operation of liquid bath vacuum cleaners may be obtained by referring to the previously identified U.S. patents.

With reference to FIG. 2, an exploded perspective view of a separator assembly 76 in accordance with the present invention is shown. The separator 76 generally comprises an annular, cup-like housing 78 removably attachable by nut 70 to the motor shaft 38 and adapted to rotate coaxially with the motor shaft 38. The nut 70 preferably has a chamfered end 80 for helping to maintain the concentricity of the separator 76 with the motor shaft 38. A spider 82, removably attachable to the housing 78, matingly engages the housing 78 to provide additional structural support to the housing 78 and to provide radial acceleration to an air mass within the separator 76. The spider 82 is secured to the shaft by a hexagonal nut 83.

The housing 78 may be made from virtually any rigid material, but preferably will be injection molded from "Rynite", a glass filled polyester compound commercially available from the DuPont Corporation. This compound is particularly desirable due to its relatively light weight and high strength characteristics.

The housing 78 comprises a longitudinal, upper flanged portion 84; a slightly conical side portion 86; a longitudinal bottom portion 88 having an integrally formed boss portion 89 with a hexagonal shaped recess 90, the bottom portion 88 further having an annular opening 91 for receiving the motor shaft 38; and a plurality of vertically oriented, elongated slots 92 (hereinafter "intake/exhaust slots") circumferentially disposed uniformly around the side portion 86 for acting as a combination of intake and exhaust means. The intake/exhaust slots 92 also define a plurality of circumferentially spaced rib portions 93. The intake/exhaust slots 92 further have upper and lower portions 94 and 96 respectively, with the lower portion 96 of each slot 92 operable to act as an intake means and the upper portion 94 of each slot 92 operable to act as an exhaust means. The functions of the upper and lower portions 94 and 96 will be discussed further in the following paragraphs. Together, the upper flanged portion 84, vertical side portion 86, and the bottom portion 88 form an integral, one-piece structure.

The hexagonal recess 90 of boss portion 89 is adapted to fit over the hexagonal nut 83 when the housing 78 is matingly engaged with the spider 82. This feature helps facilitate removal of the nut 70, which may on occasion become corroded to the shaft 38, when the housing 78 is to be removed for cleaning. By providing the hexagonal-shaped recess 90, the housing 78 may be gripped when turning the nut 70, and will help to hold the shaft 38 stationary via its form-fitting coupling over the hexagonal nut 83, while turning the nut 70. It should be understood that a variety of shapes for the recess 90 could be used in lieu of a hexagonal shape, as long as the nut 83 is shaped similar to the recess 90.

The housing 78 also includes a support ring 98 affixed to an outer edge 100 of the upper flanged portion 84. The support ring 98 will preferably be made from a rigid, lightweight material such as aluminum, and may be rolled onto outer edge 100 by any machine suitable to rotate the housing 78 360 degrees about its vertical axis while form fitting the support ring 98 to the outer edge 100 of the upper flanged portion 84. The support ring 98 serves to provide even further additional structural support to the housing 78 to help it withstand the large centrifugal force exerted on it during operation of the separator 76.

The spider 82, which is preferably injection molded from a rigid material such as Rynite, comprises an annular shoulder portion 102, a raised boss portion 104 having an annular opening 106 coaxial with the opening 90 in the housing 78 for receiving the motorshaft 38, and an inner, vertical, annular portion 108 disposed coaxially with the raised boss portion 104. The spider 82 also includes a substantially flat base portion 110 for connecting the boss portion 104 to vertical annular portion 108. Further included are a plurality of elongated, outwardly and downwardly protruding vanes 112 disposed circumferentially around the annular shoulder portion 102. The vanes 112 connect the annular shoulder portion 102 with the vertical annular portion 108, and a portion of each vane 112 extends over the upper surface of the shoulder portion 102 to the outer edge of the shoulder portion 102 to form a plurality of rib sections 114. The rib sections 114 operate to generate a positive airflow outwardly from the separator 76 to create a "labyrinth seal" between the upper surface of the shoulder portion 102 and the lower surface of the blower 18 which prevents particulates from entering the separator at that point and circumventing the operation of the separator 76.

The vanes 112 are adapted to reside in nestable fashion primarily within the side portion 86 of the cup-like housing 78, and have angled edges 116 which will be resting in abutting contact with inside portions of the side portion 86 of the housing 78 when the spider 82 is attached to the housing 78 (as is shown most clearly in FIG. 3). The vanes 112 are also preferably spaced apart from each other in a uniform fashion. Together, the annular shoulder portion 102, the vanes 112, the vertical annular portion 108, the base portion 110 and the boss portion 104 comprise an integrally formed, single piece structure. It should be understood, however, that the vanes 112 of the spider could instead be integrally formed with the housing 78, as has been illustrated in subsequent figures herein. Integrally forming the vanes 112 with the spider 82, however, allows the interior surfaces of the housing 78 and the vanes 112 to be periodically cleaned more easily and effectively. Also, forming the vanes 112 integrally with the spider 82 rather than with the housing 78 enhances the ease with which the housing 78 may be manufactured.

In FIG. 3, the separator 76 of FIG. 2 is illustrated showing the spider 82 and housing 78 in an assembled state. The spider 82 includes an annular, lower shoulder portion 118 adapted to rest nestably within a mating shoulder portion 120 of the housing 78. Together, the shoulder portions 118 and 120 form a relatively air-tight seal, the function of which will be explained below.

Turning now to the specific operation of the separator 76, from FIG. 3 it can be seen that fine dust and dirt particulates, represented by the shaded circles 122, entrained in the intake air 124, which have not been trapped by liquid bath filter 34 (shown in FIG. 1), are drawn into the cup-like housing 78 through the lower portions 96 of each intake/exhaust slot 92, which operate initially as intake means. In addition, liquid particulates, or droplets, represented by unshaded circles 126, having diameters of about 2–10 microns are also drawn in from the liquid bath filter 34 through the lower portion 96 of each intake/exhaust slot 92. This is due in part (1) to the unique configuration of the intake/exhaust slots 92, which will be discussed further below, (2) in part to the vacuum-like force created by the blower 18 (shown in FIG. 1), and (3) in part to the rapidly axially rotating vanes 112 of the spider 82, all of which will typically be rotating together at preferably about 10,000–15,000 rpm to produce a force of about 10,000–15,000 Gs. Large liquid, dust and dirt droplets, i.e., droplets having a diameter greater than about 10 microns, will be restricted by the separator 76 from entering its internal area due primarily to the size and configuration of the intake/exhaust slots 92, and due also to the high centrifugal force imparted on the air mass in the near vicinity of the separator by the intake/exhaust slots 92 and the ribs 93.

A portion of the liquid droplets larger than about 10 microns in diameter will also be broken down into droplets having diameters within the range of about 2 to 10 microns when they collide with the rapidly rotating ribs 93 of the housing 78 as they attempt to pass through the intake/exhaust slots 92. Once inside the housing 78, the liquid droplets 126 form a "fog-like" arrangement of fine liquid droplets 126. As they move toward the boss portion 89 at the axial center of the housing 78, the spacing between the liquid droplets 126 is substantially reduced, which increases the probability of collisions between them and the dust and dirt particulates 122.

As the dust and dirt particulate-entrained air 124 and the liquid droplets 126 collide inside the interior area of the housing 78, they will then coalesce, as shown at 128. This is due in large part to the rapidly rotating nature of the air mass within the housing 78. As the dust and dirt particulates 122 and the water droplets 126 coalesce, their mass to surface area ratio increases. This causes them to precipitate toward the side portion 86 of the housing 78 in response to the centrifugal force generated within the housing 78. During this coalescing process some of the liquid droplets 126 will combine with each other, thus simulating the process of rain formation in nature.

As the coalescing particulates, represented by partially shaded circles 130, are drawn upwardly by the suction force of the blower 18 and forced outwardly by the centrifugal force generated within the housing 78, they will pass through the upper portions 94 of the intake/exhaust slots 92 as indicated by airflow arrow 132. The coalescing particulates 130 are forced outwardly towards the side portion 86 of the housing largely because of the increased centrifugal force experienced by them as they move upwardly toward the upper flanged portion 84 of the housing 78. The increased centrifugal force near the upper flanged portion 84, as opposed to the bottom portion 88 of the housing 78, results because of the larger diameter of the housing 78 near the upper flanged portion 84. A portion of the coalesced liquid, dust and dirt particulates 130 may also be temporarily trapped by the rotating vanes 112 of the spider 82 but will also eventually be exhausted through the upper portions 94 of the intake/exhaust slots 92 by the centrifugal force created by the vanes 112.

After being exhausted from the housing 78, most of the coalesced liquid, dust and dirt particulates 130 will descend into the liquid bath filter 34 (shown in FIG. 1) where they will be trapped therein. The remainder of exhausted particulates 130 will descend along the inside surface of the water pan 20 and portions of surfaces defining the inlet port 32 (both shown in FIG. 1), and will also eventually be trapped in the liquid bath filter 34, or will be re-intaked into the separator 76 for further separation. A clean air mass 134 will then be left within the separator 76, which will then be drawn upwardly by blower 18 (shown in FIG. 1) out of the interior area of the separator 76, as indicated by airflow arrow 136, and eventually expelled into the ambient environment.

The separator 76 thus functions to actually provide first and second stages of separation: fist, restricting the access of large particulates and second, separating the smaller particulates which are allowed to enter its interior area from the intaked air.

The relatively air-tight seal created by mating shoulder portions 118 and 120 will also help to increase the efficiency of the separator 76. This seal will prevent any expelled liquid, dust and dirt particulates 130 from reentering the separator 76 where the spider 82 and housing 78 meet, thereby circumventing the air filtration operation of the separator 76. Also, the rib sections 114 of the spider 82 will help to prevent dust and dirt entrained air from entering the separator 76 by creating a secondary airflow directed outwardly from the separator 76.

Several additional factors also cooperate to permit the intake of liquid particulates through the lower portions 96 of the intake/exhaust slots 92, and the exhaust of the particulates through the upper portions 94. First, the angle 138 of the side portion 86 from an imaginary vertical line 140 orthogonal to flanged portion 84 has been found to be one factor that influences the intake of liquid droplets 126. If this angle 138 is within the range of about 5° to 20°, and preferably about 10° to 12°, the lower portions 96 of the intake/exhaust slots 92 will tend to act as intakes to allow entry of liquid droplets 126 having diameters of about 2–10 microns.

Another factor is the length of the intake/exhaust slots 92. The length of each intake/exhaust slot 92 will preferably be maximized so that each slot 92 extends along almost the entire vertical side portion 86. This further helps enable the lower portions 96 to act as an intake means and the upper portions 94 to act as exhaust means.

Figure 4:
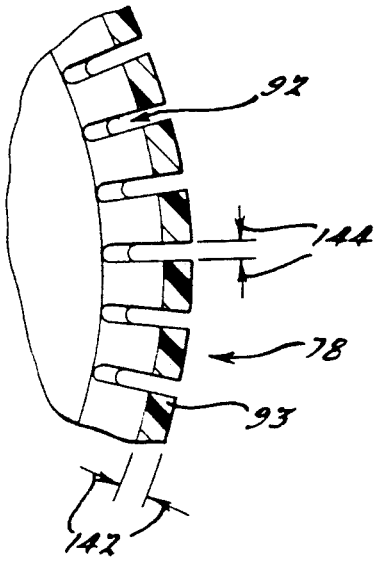
FIG. 4 is a cross-sectional plan view along direction line 4—4 of FIG. 3.

Referring now to FIG. 4, another factor in the performance of the separator 76, the intake/exhaust slot depth-to-width ratio, will be explained. In order for the intake/exhaust slots 92 to function properly as both an intake and exhaust means, the depth 142 of each slot 92 should preferably be about two to three times as great as the width 144 of each intake/exhaust slot 92. The depth 142 of each intake/exhaust slot 92 will be preferably about 0.120 to 0.180 inches, while the width of each slot 92 will be preferably about 0.040–0.060 inches. If this two-to-one to three-to-one ratio is maintained, the intake/exhaust slots 92 will function to allow entry and exhaust of liquid, dust and dirt particulate entrained air while minimizing the loss of suction-like force provided by the blower 18 and the degradation of airflow through the vacuum system 10.

The overall ability of the separator 76 to remove liquid, dust and dirt particulate entrained air will also depend on the number of intake/exhaust slots 92 included in the housing 78. Preferably the number of intake/exhaust slots 92 should be maximized. It has been found, however, that if the total number of intake/exhaust slots 92 is between about 40 to 110 and preferably between 70 to 80, with the slot width-to-depth ratio being preferably about two or three to one as described above, a desirable balance will be achieved between maximizing the separating ability of the separator 76 and maintaining the structural strength of the housing 78.

Drawing liquid droplets into the separator 76 and allowing them to coalesce with the dust and dirt particulates entrained in the intake air serves to significantly increase the centrifugation of the dust and dirt particulates from the intake air. This activity has further been found to improve the amount of dust and dirt particulates removed by the separator 76 from the intaked air by up to 50% for certain types of particulate matter. More specifically, improvements in the number of fine dust particulates (i.e., particulates having diameters of 0.3 to 10.0 microns) removed from the intake air over a 30 second period range from about 19% to 57%. Improvements in the removal of fused alumina particulates having diameters of about 0.3 to 10.0 microns have also been found to range from about 16% to 79% for various particulate sizes when tested over a 30 second period. Improvements in the removal of calcinated aluminum oxide particulates and ambient air particulates of similar diameters and for a similar time period have also been found to range up to 85% for some calcinated aluminum oxide particulates, with the mean increases for calcinated aluminum oxide particulates and ambient air particulates being approximately 40% and 15% respectively.

Although the separator 76 is operable to allow liquid droplets to enter its inner area, and works most effectively when used in connection with liquid droplets, it should be understood that it will also function without a liquid agent. Using a liquid agent to provide liquid particulates, however, eliminates several problems that could possibly result if the same improvements in separation of dust and dirt particulates (i.e., about 50%) were sought to be obtained without a liquid agent. For example, to achieve a marked increase in separation efficiency, for example 50%, using the separator 76 in a dry system (i.e., one in which a liquid source was not available to provide liquid droplets), either the diameter of the separator 76 would have to be increased or the separator 76 driven at a higher angular velocity to increase the centrifugal force it creates, or both.

Increasing the diameter significantly can result in a marked reduction of airflow through the system. A significantly larger diameter separator would also likely introduce additional vibration problems. Increasing the angular velocity significantly would likely increase the stress on the various components of the separator beyond acceptable levels. Using a liquid agent to provide liquid droplets and drawing the liquid droplets into the separator thus allows a smaller diameter separator to be used. This also allows the separator to be driven at a lower angular velocity, thereby avoiding the structural strength problems which would otherwise likely be incurred if liquid droplets were not used in the system.

Figure 5:
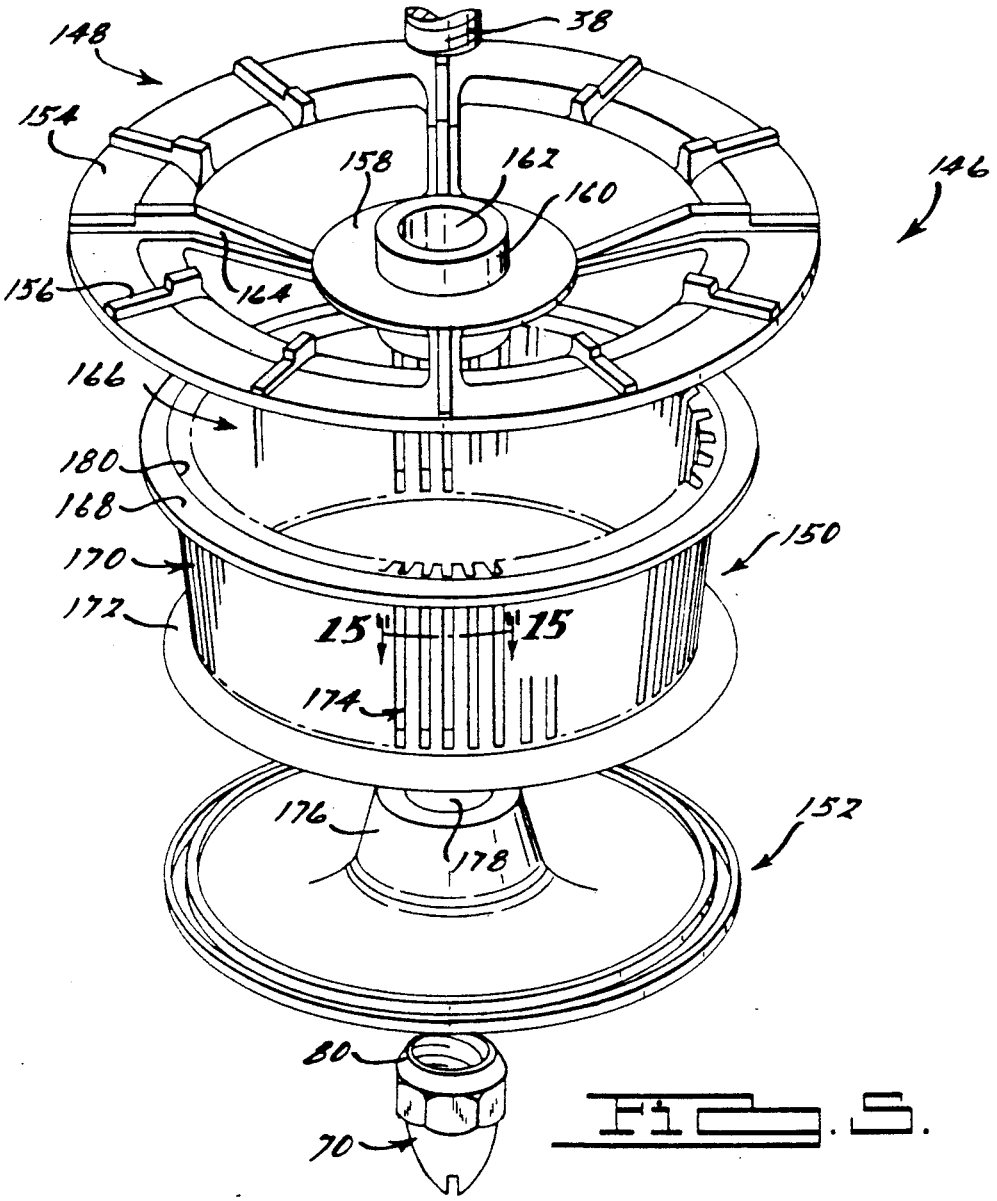
FIG. 5 is an exploded perspective view of a second preferred embodiment of the separator showing a housing, a spider, and a lower support cover.

Referring now to FIG. 5, a second preferred embodiment of the present invention is shown. This embodiment generally comprises a separator assembly 146 having a removably attachable annular spider 148, an annular housing 150, and an annular, lower support cover 152. The spider 148 and housing 150 will both preferably be formed by injection molding, and will preferably be formed from a material having a rigid final form, such as Rynite.

The spider 148 comprises an annular shoulder portion 154 having a plurality of ribs 156 directed radially outwards from its axial center. The ribs 156 function to help provide a positive airflow outwardly of the separator 146 to create a labyrinth seal which prevents entry of particulates near the shoulder portion 154.

The spider 148 also comprises an annular center portion 158 having an elongated, annular, boss portion 160 with an annular opening 162 for receiving the motor shaft 38. Also included are a plurality of vanes 164 extending radially outward from the center portion 158 to the shoulder 154 and angled sufficiently downwardly so as to partially reside within an interior area 166 of the housing 150 when the spider 148 is attached thereto. The vanes 164 operate to help produce the centrifugal force which is needed to separate the coalesced liquid, dust and dirt particulates entrained in the intake air, the process of which will be described in detail below.

The housing 150 comprises an annular upper flange portion 168, a slightly angled side portion 170, and a rounded, annular bottom portion 172. The side portion 170 includes a plurality of elongated, vertically orientated slots 174 (hereinafter "intake slots") which act as intake means to allow liquid, dust and dirt particulates to enter the interior 166 of the separator 146. For simplicity, the support ring 98 of separator 76 has not been illustrated in FIGS. 5 and 6, although it should be understood that the ring 98 may be so incorporated to provide further structural strength to the housing 150.

The lower support cover 152 also has a raised, boss portion 176 with an annular opening 178 for receiving the motor shaft 38. The lower support cover 152 is of a solid, rigid construction throughout to make it impervious to liquid or solid particulate matter, and is preferably stamped from a mold out of aluminum or a like material which is structurally strong and yet lightweight. The boss 89, hexagonal recess 90, and spider nut 83 of FIGS. 2 and 3 have not been illustrated in FIG. 5, nor in the remaining Figures, so as not to unnecessarily complicate the drawings. It should be understood, however, that the embodiment of FIG. 5 and the following embodiments will also preferably incorporate such a boss 89, recess portion 90, and nut 83 to further enhance the ease with which the housings of each of the embodiments may be removed.

Figure 6:
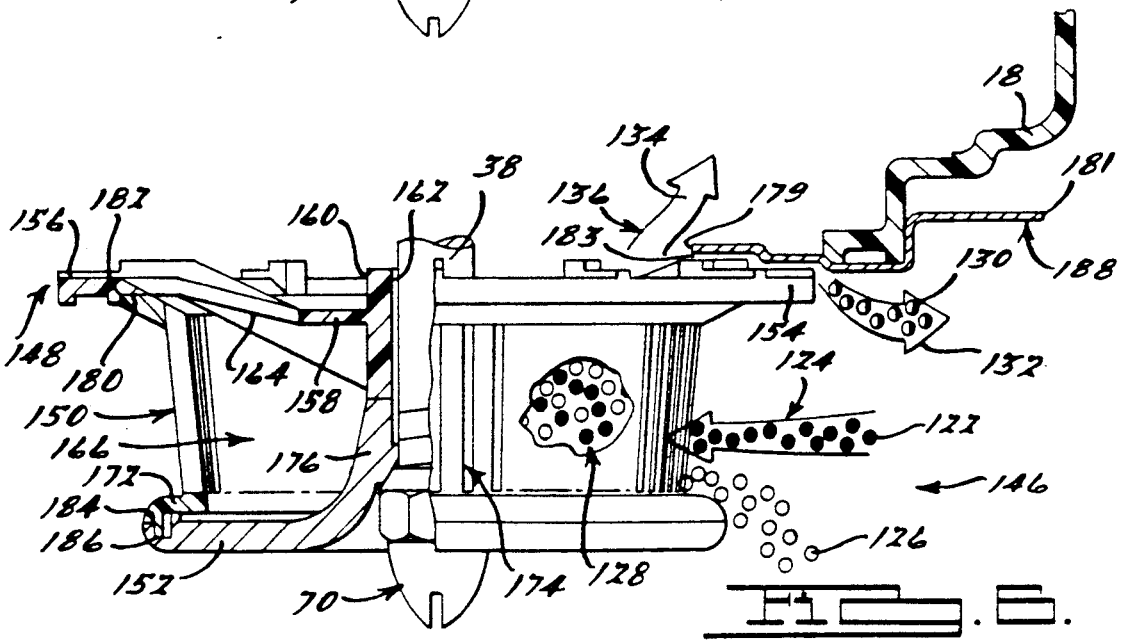
FIG. 6 is a side elevational view partially in cross-section of the separator of FIG. 5 and a partial side cross-sectional view of an air deflector flange.

Referring now to FIG. 6, the upper flange portion 168 of the housing 150 also has an annular shoulder portion 180 for resting inside and abutting against a mating annular shoulder portion 182 (not visible in FIG. 5) of the spider 148. The housing 150 also has a similar shoulder portion 184 for resting inside and abutting against an annular groove 186 of the lower support cover 152. The shoulder and groove portions 182 and 186 of the spider 148 and lower support cover 152 respectively serve to provide support to the housing 150, thereby increasing its structural rigidity to further help it to withstand the centrifugal force applied to it when the separator 146 is in operation, spinning at a high angular velocity. The support provided by shoulder portion 182 and groove 186 also allows thinner and lighter materials to be used in the construction of the housing 150, thereby conserving space and weight.

Initially, it should be mentioned that FIG. 6 also illustrates an annular air deflector flange 188 (not used in the embodiments of FIGS. 2-4) preferably attachable to the blower 18, as illustrated in FIG. 6, or any member near the top of the spider 148. The air deflector flange 188 is operable to cover at least a portion of the shoulder portion 154 of the spider 148, and preferably will be of a diameter sufficiently large enough so as to extend outwardly beyond the shoulder portion 154. The air deflector flange 188 may be made of a wide variety of materials, but will preferably be stamped from a mold out of a rigid material such as metal or injection molded from a plastic or other similar compound.

Returning to the operation of the separator 146 of FIG. 6, dust and dirt particulate entrained air enters the intake slots 174 from lower chamber area 33 (shown in FIG. 1), as indicated by the small, shaded circles 122 within airflow arrow 124. Liquid droplets from the liquid bath filter 34 (shown in FIG. 1) are also drawn in through the intake slots 174, as indicated by small, unshaded circles 126, by the configuration of the intake slots 174, the suction force created by the blower 18, the rapidly, axially rotating annular housing 150 and the spider 148. Once inside the interior area 166 of the annular housing 150, the liquid droplets 126 coalesce as indicated at 128, with the dust and dirt particulates 122 to form a relatively homogeneous mixture of particulates 130. The large centrifugal force developed within the separator 146 will then operate to separate, (i.e., centrifuge) the liquid, dust and dirt particulates from the rapidly rotating air mass within the separator 146.

The coalesced and separated liquid, dust and dirt particulates 130 will then be drawn upwardly and forcibly expelled through a passageway 183, acting as an exhaust means, formed between the shoulder 154 of the spider 148 and the underside of the air deflector flange 188, as indicated by directional arrow 132. The exhaust of the coalesced particulates 130 is accomplished by a combination of the suction created by the blower 18, the centrifugal force produced by the housing 150 and the vanes 164 of the spider 148. The separated liquid, dust and dirt particulates 130 will then descend into the liquid bath filter 34 (shown in FIG. 1) where they will be trapped therein. The clean air mass 134 left within the separator 146 after the coalesced liquid, dust and dirt particulates 130 have been exhausted will then be drawn upwardly by the blower 18, as indicated by airflow arrow 136, through the vacuum system 10 and eventually expelled back into the ambient environment.

As with the preferred embodiment discussed in connection with FIGS. 2, 3 and 4, the depth-to-width ratio of the intake slots 174 of the separator 146 of FIGS. 5 and 6 is also a factor in allowing the proper amount of liquid droplets to enter the separator 146 and for minimizing the drag created on the blower 18 and motor 16 when liquid droplets 126 are allowed to enter the separator 146. The depth-to-width ratio is preferably about the same, however, as the depth-to-width ratio of the separator of FIGS. 2-4 (i.e., preferably about two-to-one to three-to-one), as explained in the discussion of FIGS. 2 and 4.

Figure 7:
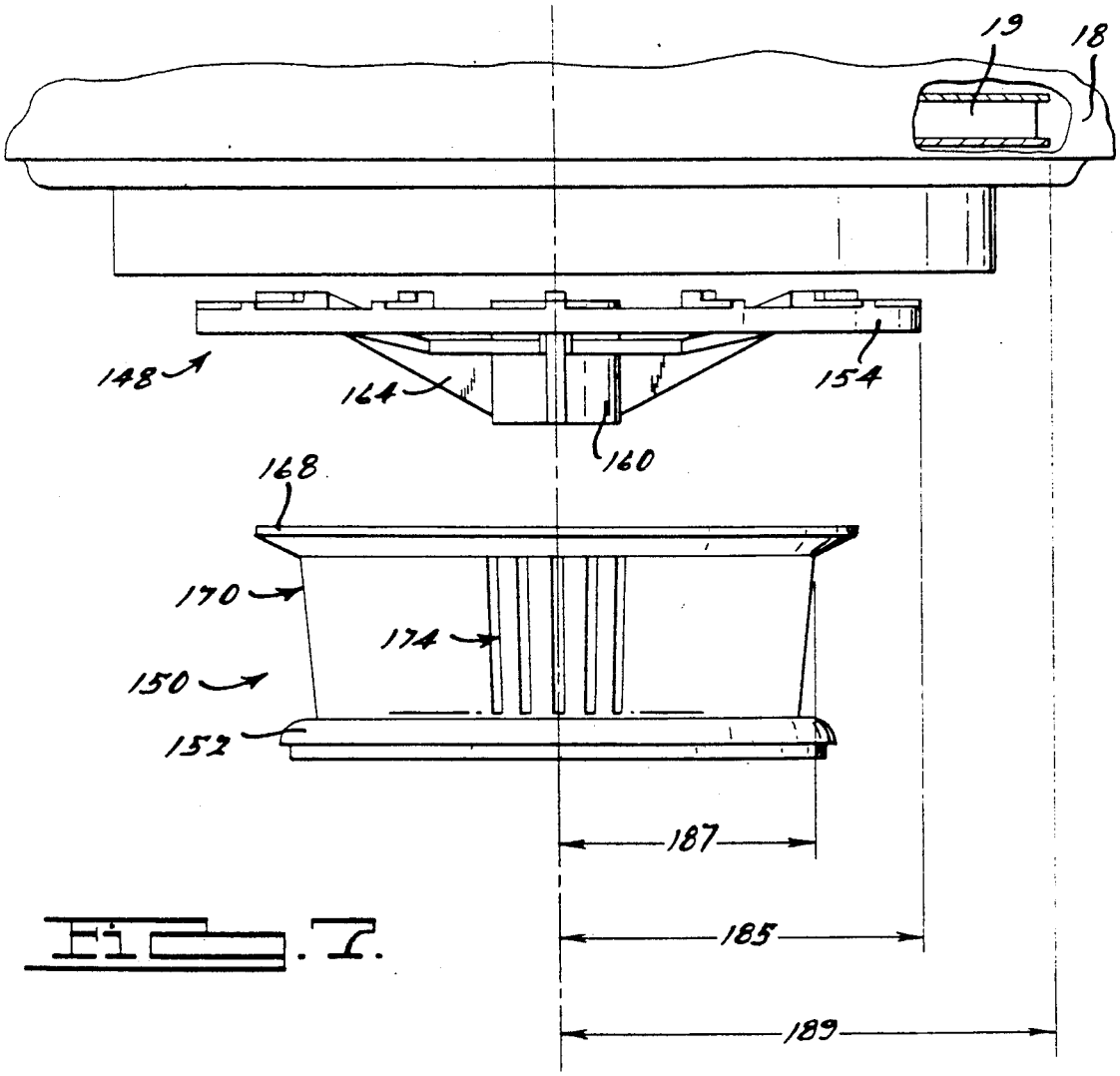
FIG. 7 is an exploded schematic side view of the spider and the housing of FIGS. 5 and 6, a portion of the blower of FIG. 1 and its internal fan blades indicating the various relative outer diameters of each which influence the operation of the separator.

Still another factor that affects the performance of the separator 146 is the relative outer diameters of the fan assembly 19 of the blower 18, the flanged shoulder portion 154 of the spider 148, and the housing 150. Referring now to FIG. 7, for optimum performance, i.e., that point where liquid droplets just begin to enter the intake slots 174, the outer radius 185 of the shoulder portion 154 of the spider 148 will be about 20% to 60%, and preferably about 40%, greater than the mean outer radius 187 of the vertical side portion 170 of the annular housing 150. The outer radius 189 of the fan assembly 19 of the blower 18, in turn, should be about 20% to 60%, and preferably about 40%, greater than the outer radius of the flanged shoulder portion 154 of the spider 148. The blower 18 should further be operable to provide a suction-like airflow of about 70 cfm (cubic feet of air per minute). If the above mentioned ranges are met, adverse affects on the ability of the vacuum system 10 to provide a strong, suction force will be minimized, as will any adverse affects on the air flow through the vacuum system 10. It should also be appreciated that the above ratios will affect the performance of each of the separators disclosed herein, and as such should preferably be met with respect to the other embodiments of the present invention to achieve optimum performance.

It is thus a key aspect of the present invention that the lower portions of the intake slots of each embodiment of the present invention function to allow liquid droplets to enter the separator. As can be seen, this function is dependent on a combination of factors, namely the slot width-to-depth ratio, the rotational speed of the motor assembly 16, and the air movement capacity of the blower 18, which must be considered for each embodiment discussed herein.

Figure 8:
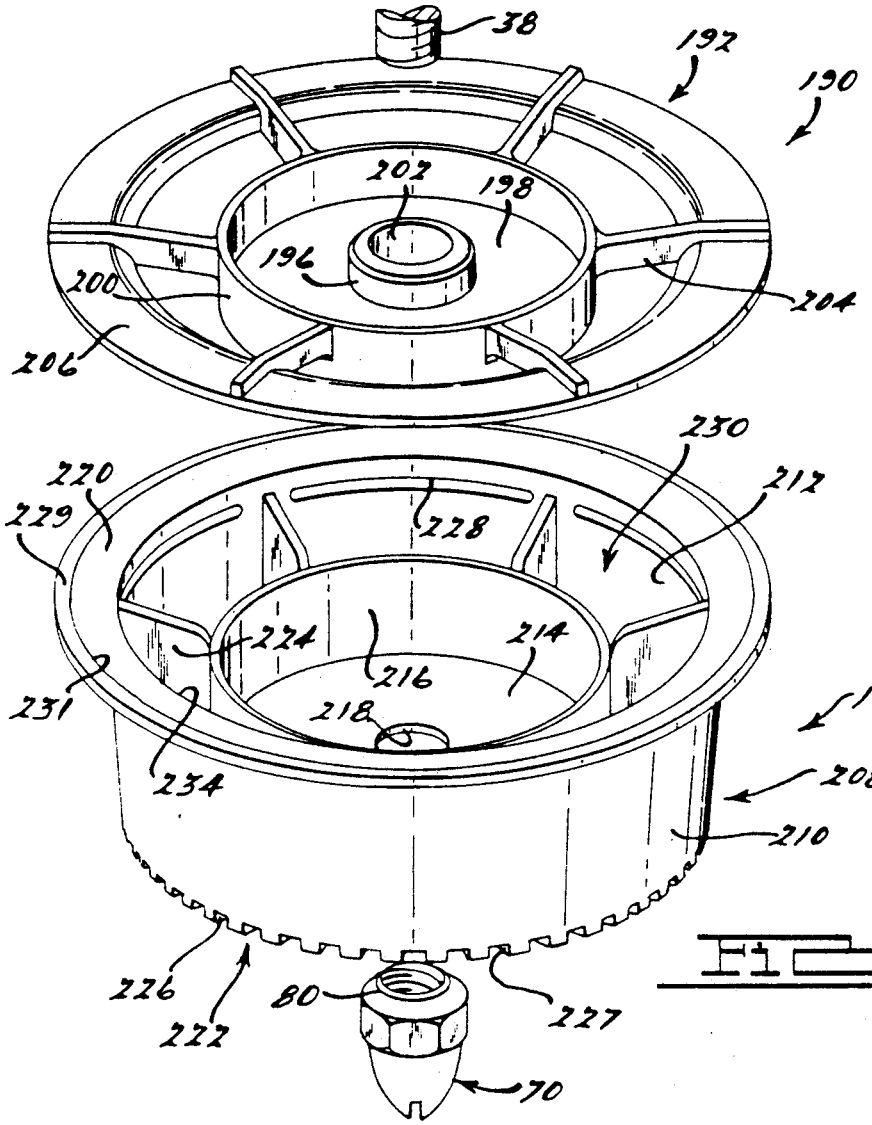
FIG. 8 is an exploded perspective view of a third preferred embodiment of the present invention showing an annular, cup-like housing and a spider.

Referring now to FIG. 8, an alternate embodiment of the present invention is shown generally comprising a separator assembly 190 having an annular spider 192 and an annular, cup-shaped housing 194. The spider 192 has a raised, annular, boss center portion 196 integrally formed with a longitudinal base portion 198 and a vertical, annular inner wall 200. An annular opening 202 is included in center portion 196 for receiving the motor shaft 38. The spider 192 also has a plurality of vanes 204 extending radially outward from the annular inner wall 200 to an annular, flange portion 206. The vanes 204 are also angled downward slightly from the flange portion 206 to allow them to reside partially within the housing 194 when the separator 190 is assembled. The spider 192 generally operates to provide additional structural support to the housing 194 and to help generate centrifugal force within the housing 194. The spider 192 may be manufactured from any suitable rigid material, but will preferably be injection molded from a plastic or similar material, such as Rynite.

The housing 194 has a side portion 208 having an outer wall 210 and an inner wall 212, and further includes an annular base portion 214 and an internal, vertical sidewall 216. The base portion 214 has an annular opening 218 for receiving the motor shaft 38. Together the side portion 208, the center portion 214 and the inner sidewall 216 form an integral structure. The housing 194, like the spider 192, will preferably be injection molded from a rigid material, such as Rynite.

The housing 194 will also preferably include an upper flanged portion 220, a botton portion 222 (shown most clearly in FIG. 10), and a plurality of vanes 224 bridging the inner wall 212 of the side portion 208 and the internal vertical sidewall 216 for enhancing the radial acceleration of the air mass within the separator 190. It should be understood, however, that the vanes 224 could be easily formed with the spider 192 if so desired, as is generally shown in the spider 82 of FIG. 2. In practice, the vanes 224 will preferably be formed with the spider 192 for the reasons set forth hereinbefore, and the vanes 224 have been shown in FIGS. 8 and 9 formed with the housing 208 to merely illustrate this alternative configuration.

The housing 194 further includes a plurality of slots 226 (hereinafter "intake slots") disposed in the bottom portion 222 and a plurality of longitudinally oriented elongated apertures 228 circumferentially spaced in the side portion 208 of the separator 190 near the upper flanged portion 220. The intake slots 226 extend radially outward from the annular opening 218 in a longitudinal fashion, as can be seen most clearly in FIG. 10, and act primarily as intake means to allow liquid, dust and dirt particulates to enter an interior area 230 of the housing 194. Portions 227 of the intake slots 226 also open onto the side portion 208, and operate to allow the exhaust of a very small amount of particulate matter therethrough. The longitudinal exhaust apertures 228 are operable to act as an exhaust means to allow coalesced liquid, dust and dirt particulates within the separator 190 to be centrifugally exhausted therefrom. It should also be mentioned that although only a single row of exhaust apertures 228 has been illustrated in FIGS. 8 and 9, the side portion 208 of the housing 194 could optionally include more than one row of exhaust apertures 228 to further increase the ability of the separator 194 to exhaust particulates therefrom. Furthermore, the exhaust slots need not be longitudinally oriented but instead could be disposed vertically in circumferential fashion around the housing 194. An advantage if the exhaust apertures 228 are disposed in a vertical fashion is that the centrifugal force developed by the separator 194 is sufficient to expel particulates therein even without vanes 224.

Also shown in FIG. 8 is an annular support ring 229 affixed to the outer edge 231 of the housing 194. This support ring 229 provides additional structural support to the housing 194, and is essentially similar to the support ring of separator 76.

Figure 9:
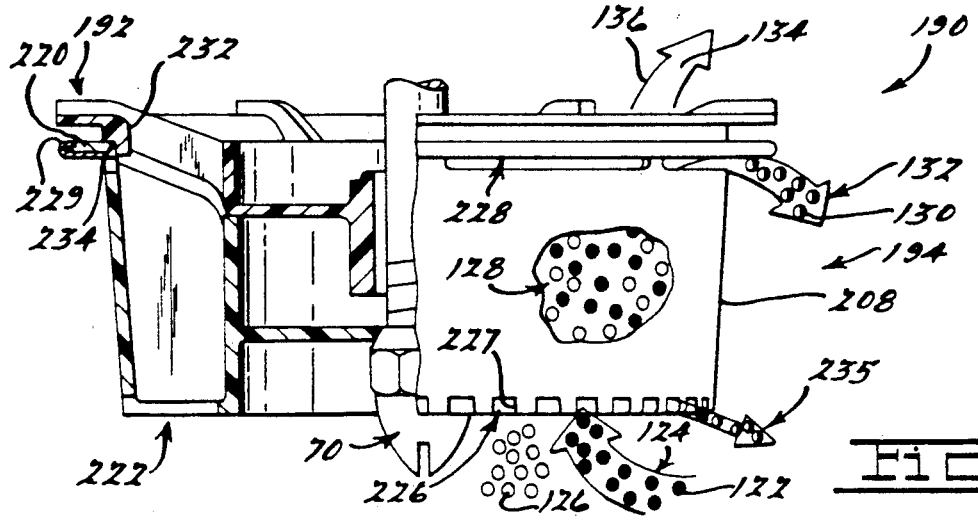
FIG. 9 is a side elevational view partially in cross-section of the separator of FIG. 8.

Referring now to FIG. 9, an annular, lower shoulder 232 of the spider 192 is shown for abuttingly engaging with an inner edge 234 of upper flanged portion 220. Shoulder 232 and edge 234 serve to provide a relatively airtight seal to prevent dust and dirt entrained air from entering the separator 190 where the spider 192 and the housing 194 meet and circumvent the operation of the separator 190.

As shown by the shaded circles 122 within airflow arrow 124, dust and dirt particulates entrained in the intake air will enter through the intake slots 226 along with liquid droplets 126 from liquid bath filter 34 (shown in FIG. 1). Once inside the rapidly rotating housing 194, the liquid droplets 126 and the dust and dirt particulates 122 entrained in the intake air will coalesce, as indicated at 128. The centrifugal force provided by the housing 194 and vanes 204 and 224 will operate to separate and force the great majority of the coalesced liquid, dust and dirt particulates 130 from the air mass upwardly and outwardly through the exhaust apertures 228, as indicated by airflow arrow 132. The exhausted dust and dirt particulates 130 will then descend towards the liquid bath filter 34 and be trapped. A portion of the separated liquid, dust and dirt particulates 130 may be temporarily trapped against the vanes 204 and 224, but will also eventually be exhausted through the exhaust apertures 228 due to the centrifugal force created by the vanes 204 and 224 within the housing 194. The clean air mass 134 left within the separator 190 will then be drawn upwardly out of the separator 190, as indicated by airflow arrow 136, and eventually expelled back into the ambient environment.

Figure 10:
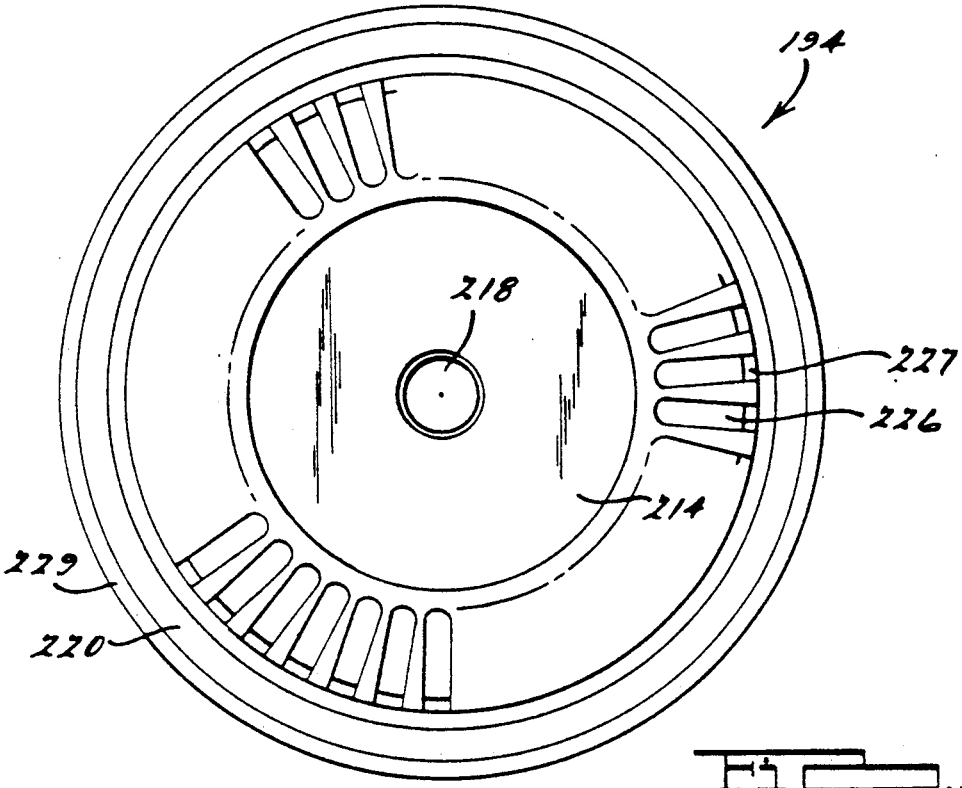
FIG. 10 is a bottom elevational view of the separator of FIGS. 8 and 9 showing more clearly the bottom portion of the cup-like housing and the intake slots therein.

The embodiment of the separator 190 shown in FIGS. 8, 9 and 10 has the added advantage of providing a longer period of time for the liquid, dust and dirt particulates 126 and 122 to coalesce and be separated before they reach the exhaust apertures 228. This is because the liquid, dust and dirt particulates 126 and 122 enter through the bottom portion 222 of the housing 194, and therefore must travel a distance that is longer than that which would be required for the particulates 126 and 122 to travel were they to enter the side portion 208 of the housing 194. This increased distance that the particulates must travel before reaching the exhaust apertures 228 thus allows larger, microscopic liquid particulates to be permitted to enter the housing 194, and increases the time during which the particulates are subjected to a large centrifugal force, thus enhancing the separation of the particulates by the time they reach the exhaust apertures 228.

Figure 11:
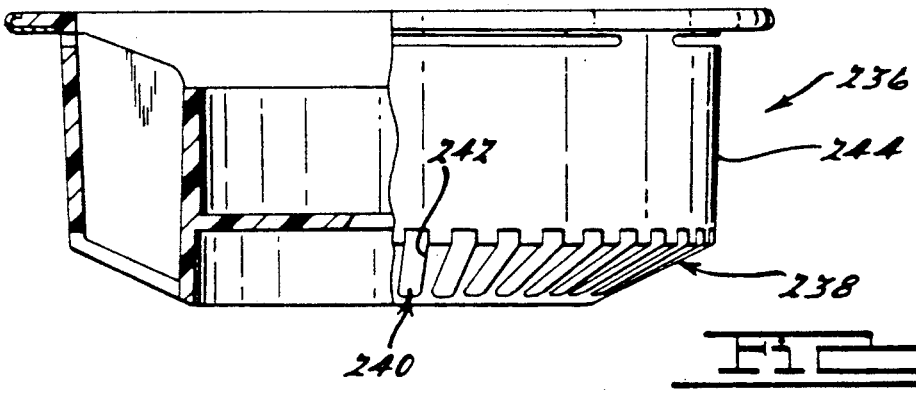
FIG. 11 is a side elevational view of a cup-like housing having an angled bottom portion, in accordance with a fourth preferred embodiment of the present invention.
Figure 12:
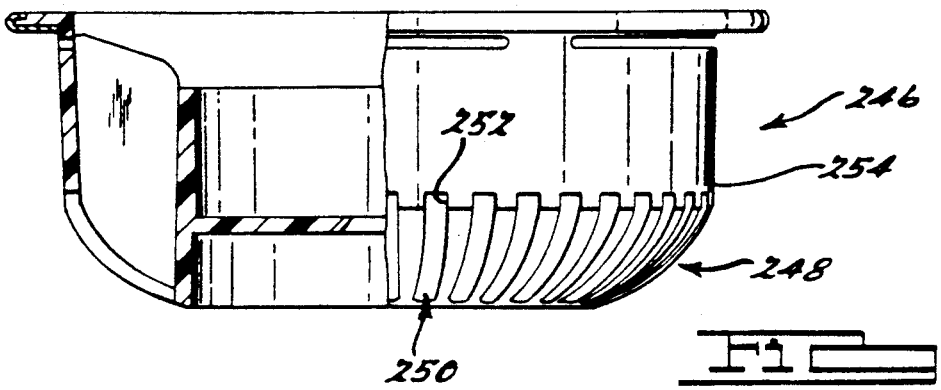
FIG. 12 is a side elevational view of a cup-like housing having a curved bottom portion, in accordance with a fifth preferred embodiment of the present invention.

Referring now briefly to FIGS. 11 and 12, two variations of the housing 194 of separator 190 can be seen. Referring first to FIG. 11, there is shown a modified cup-like housing 236 in accordance with a fourth embodiment of the present invention. In this embodiment, the cup-like housing 236 includes an angled bottom portion 238 with a plurality of elongated slots 240 (hereinafter "intake slots"). A portion 242 of each intake slot 240 further extends onto a side portion 244 of the housing 236 and each portion 242 tends to perform a small exhaust function to help exhaust coalescing liquid, dust and dirt particulates 130 (shown in FIG. 9). The preferred method of construction of the housing 194 is by injection molding, preferably from Rynite.

In FIG. 12, there is shown a modified cup-like housing 246 in accordance with a fifth embodiment of the present invention. This housing 246 includes a curved bottom portion 248 with a plurality of elongated intake slots 250. A portion 252 of each intake slot 250 further extends onto a side portion 254 of the housing 246 and also tends to perform a small exhaust function. Housing 246 will also preferably be formed by injection molding, preferably from Rynite. The angled or curved bottom portions 238 and 248 of housings 236 and 246 respectively may be used to tailor intake characteristics to allow less liquid particulates 126 (shown in FIG. 9) and dust and dirt particulates 122 to enter the separator 190. This serves to decrease the drag of the separator on the motor 16, thereby allowing a less powerful motor to be used.

From the two bottom portions 238 and 248 of FIGS. 11 and 12, it should be apparent that numerous other variations may readily be made to the housing of each embodiment of the present invention, as well as other component parts of each preferred embodiment discussed herein, to adjust airflow characteristics and the centrifugal force provided by each.

The present invention is thus well calculated to provide a low cost, easily manufactured means for allowing liquid particulates to coalesce with dust and dirt particulates entrained in intake air to thereby improve the centrifuging ability of the separator of a vacuum system. Consequently, a greater number of particulate contaminants may be removed from contaminated intake air, which contaminants would have otherwise been redeposited by other vacuum cleaner systems back into the ambient environment.

Although the present invention has been discussed in connection with a vacuum cleaner system and particular examples and illustrations thereof, it should be appreciated that the present invention may also be adapted for use in a wide variety of air filtration devices with little or no variations by those skilled in the art, and is susceptible to numerous variations without departing from the true and fair scope of the following claims.

What is claimed is:

1. For a liquid bath-type air filtration device, a separator for separating liquid droplets coalescing with dust and dirt particulates entrained in intake air through an application of centrifugal force to said intake air, said separator comprising:

annular housing means operable to rotate axially about a vertical axis for generating a centrifugal force to be applied to said intake air;

intake means operatively associated with said annular housing means for enabling dust and dirt particulates entrained in intake air to be drawn into an interior area of said annular housing means, and for enabling liquid droplets from a liquid source entrained in said intake air to be drawn into said interior area of said annular housing means to thereby enable said dust and dirt particulates and said liquid droplets to coalesce therein, whereby said coalesced liquid droplets and dust and dirt particulates are subjected to centrifugal force and are thereby separated from said intake air; and exhaust means operatively associated with said annular housing means for enabling said coalesced liquid droplets and dust and dirt particulates within said interior area of said annular housing means to be expelled therefrom as said coalesced liquid droplets and dust and dirt particulates are forced radially outward by centrifugal force towards and through said exhaust means by rapid, axial rotation of said annular housing means.

2. The separator of claim 1, further comprising:

annular spider means for covering a top portion of said annular housing means and circumscribing said top portion, said spider means being disposed coaxially with said annular housing means and operable to rotate coaxially therewith, wherein said spider means includes a plurality of vanes extending radially outwardly from an inner vertical annular portion of said spider means to an annular shoulder portion, said vanes being operable to help generate centrifugal force to be applied to said liquid, dust and dirt particulates intake into said annular housing means, and expulsion of said liquid, dust and dirt particulates therefrom, said spider means further being operable to help generate a positive outward airflow near said annular shoulder portion to help prevent entry of liquid droplets and dust and dirt particulates into said separator near said annular shoulder portion.

3. The separator of claim 1, further comprising a removable lower support cover covering a bottom portion of said annular housing means and rotate coaxially therewith, said lower support cover further being operable to provide additional structural support to said annular housing means and to restrict the intake of said liquid, dust and dirt particulates to the intake means.

4. The separator of claim 1, wherein said intake means includes a plurality of elongated slots disposed on a slightly conical side portion of said annular housing means.

5. The separator of claim 2, wherein said exhaust means comprises an air passageway formed by an annular, substantially flat air deflector flange and said spider means.

6. The separator of claim 2, wherein said centrifugal force applied to said coalescing liquid, dust and dirt particulates within said annular housing means and exhaust of said coalescing liquid, dust and dirt particulates therefrom is further facilitated by a blower having a fan assembly, said blower being disposed coaxially with said annular housing means and operable to rotate coaxially therewith.

7. The separator of claim 5, wherein said annular air deflector flange is operable to at least partially cover said shoulder portion of said spider means.

8. The separator of claim 7, wherein said spider means has an outer diameter approximately 30% to 50% greater than a means outer diameter of a substantially vertical side portion of said annular housing means.

9. The separator of claim 6, wherein said fan assembly of said blower has an outer diameter approximately 30% to 50% greater than an outer diameter of a flanged shoulder portion of said spider means.

10. The separator of claim 4, wherein providing said slot-like cut-out portions with depths approximately two to three times that of a distance that separates each adjacent slot-like cut-out portion helps facilitate the intake of said liquid particulates from said liquid source.

11. The separator of claim 1, wherein said intake and exhaust means comprise a plurality of slot-like cut-outs disposed circumferentially around a slightly conical side portion of said annular housing means, a portion of each said slot-like cut-out operating to allow an intake of said liquid, dust and dirt particulates entrained in said intake air, and a portion of each said slot-like cut-out operating to allow an exhaust of said liquid, dust and dirt particulates entrained in said intake air.

12. The separator of claim 11, wherein said annular housing means further has top and bottom portions and said slot-like cut-outs each have upper and lower portions, said slightly conical side portion being angled outwardly relative to said bottom portion, said outward angling of said slightly conical side portion operating to allow said lower portion of each said slot-like cut-out to function as said intake means and said upper portion of each said slot-like cut-out to function as said exhaust means.

13. The separator of claim 12, wherein adjacent slot-like cut-outs are separated by a predetermined distance, and wherein each said slot-like cut-out further has a depth approximately two to three times greater than said predetermined distance separating said adjacent slot-like cut-outs.

14. The separator of claim 13, wherein said predetermined distances are approximately 0.040 to 0.060 inches, with each said slot-like cut-out having a depth of approximately 0.120–0.180 inches.

15. The separator of claim 1, wherein said annular housing means further comprises:

an annular, longitudinal, upper flanged portion integrally formed with said annular housing means; and an annular support ring affixed to an outer edge of said annular, longitudinal, upper flanged portion, said annular support ring being operable to provide further structural strength to said annular housing means.

16. For a vacuum cleaner system, a separator for separating liquid particulates, dust particulates, dirt and other similar products entrained in intake air, said separator comprising:

annular, cup-like housing means operable to rotate axially about a vertical axis for generating a centrifugal force, said housing means further having a substantially flat bottom portion, a slightly conical, annular side portion and an upper flanged portion integrally formed with said substantially vertical side portion;

intake means disposed on said substantially flat bottom portion of said housing means for intaking liquid particulates from a liquid source and dust and dirt particulates entrained in intake air into an interior area of said housing means, whereby said liquid particulates coalesce with said dust and dirt particulates therein; and exhaust means disposed on said side portion of said housing means for allowing coalescing liquid, dust and dirt particulates to be exhausted from said interior area of said housing means as said coalesced liquid, dust and dirt particulates are forced radially outward by said centrifugal force towards and through said exhaust means by rapid, axial rotation of said housing means.

17. The separator of claim 16, wherein said housing means further comprises:

an annular, internal vertical sidewall disposed coaxially with said housing means; and a plurality of vanes extending radially outwardly from said internal vertical sidewall connecting said internal vertical sidewall to an interior area of said side portion of said housing means, said vanes being operable to help generate said centrifugal force to thereby help force said liquid dust and dirt particulates towards and through said exhaust means.

18. The separator of claim 16, where said intake means comprises a plurality of slot portions in said bottom portion, said slot portions extending radially outwardly from said vertical axis of said housing means.

19. The separator of claim 18, wherein said slot portions extend upwardly onto said side surface of said cup-like housing means, thereby causing said slot portions to perform a relatively small exhaust function as well as an intake function.

20. The separator of claim 16, wherein said exhaust means comprises a plurality of slot portions in said side surface of said housing means, said slot portions further being disposed circumferentially around said side portion in a longitudinal fashion.

21. The separator of claim 16, wherein said separator further comprises a removable annular spider having an annular shoulder portion and an annular inner wall disposed concentrically with said shoulder portion, said annular inner wall being connected to said shoulder portion by a plurality of vanes extending radially from said annular inner wall, said spider being operable to securely engage with said housing means and rotate coaxially with said housing means to help generate said centrifugal force to thereby force said coalesced liquid, dust and dirt particulates towards and through said exhaust means.

22. The separator of claim 21, wherein said annular, housing means further comprises an annular support ring affixed to an outer edge of said annular shoulder portion.

23. The separator of claim 16, wherein said exhaust means comprises a plurality of vertical slot portions circumferentially disposed in a uniform fashion about said side portion of said housing means.

24. The separator of claim 16, wherein said bottom portion is angled to help restrict said intake of said liquid, dust and dirt particulates into said housing means, thereby reducing the power required to drive said separator.

25. The separator of claim 16, wherein said bottom portion is curved to help restrict the intake of said liquid, dust and dirt particulates into said housing means, thereby reducing the power required to drive said separator.

26. The separator of claim 16, wherein said separator operates to provide first and second separation stages;

said first separation stage comprising impeding large dust and dirt particulates from entering said intake means; and said second separation stage comprising said intake of said liquid particulates and said dust and dirt particulates entrained in intake air, axially rotating said housing means to help generate centrifugal force to help facilitate coalescence of said liquid, dust and dirt particulates, and exhaust of said coalesced liquid, dust and dirt particulates through said exhaust means of said housing means.

27. The separator of claim 16, further comprising an annular support ring affixed to said shoulder portion for providing further structural support to said housing means.

28. For a vacuum cleaner system, a separator operable to rotate axially about its vertical axis for removing dust and dirt particles from intake dust and dirt entrained air through centrifugation of said dust and dirt entrained air, said separator comprising:

annular, cup-like housing means having a vertical axis for generating a centrifugal force on an intake air mass within said housing means when said housing means is rotated axially about said vertical axis;

a first plurality of slots in said housing means operable to act as an intake to allow liquid particulates from a liquid source and dust and dirt particulates entrained in intake air to enter therethrough into an interior area of said housing means, whereby said liquid particulates coalesce with said dust and dirt particulates;

a second plurality of slots in said housing means operable to act as an exhaust to allow coalescing dust and dirt particulates to be forced from said interior area of said housing means by said centrifugal force, said liquid particulates acting to enhance said exhaust of said dust and dirt particulates; and a detachable spider member positioned concentrically with said housing means, said spider member further having a plurality of vanes resting partially within said housing means and operable to further generate centrifugal force therein.

29. The separator of claim 28, wherein said housing means has longitudinal top and bottom portions and a side portion angled outwardly relative to said bottom portion, said first plurality of slots being disposed in said bottom portion in a radially outward fashion and said second plurality of slots being disposed longitudinally in said side portion.

30. The separator of claim 28, wherein said second plurality of slots are vertically oriented circumferentially around said side portion of said housing means.

31. For a vacuum cleaner system, a separator operable to draw in liquid droplets from a liquid source and dust and dirt particulates from ingested dust and dirt particulate entrained air by the application of centrifugal force to said dust and dirt particulate entrained air, said separator comprising:

annular, cup-like housing means having top, side and bottom portions, and a vertical axis, for generating said centrifugal force when said housing means is rotated axially about said vertical axis; and a plurality of elongated slots formed in said side portion, said slots having upper and lower portions, said lower portions being operable to provide an intake of said dust and dirt particulate entrained air and liquid droplets from a liquid source therethrough, whereby said liquid droplets and said dust and dirt particulate entrained air coalesce inside said housing means, thereby helping facilitate separation of said dust and dirt particulates from said dust and dirt particulate entrained air;

wherein said upper portions of said slots operate to enable said liquid droplets coalesced with said dust and dirt particulates to be exhausted therethrough by said centrifugal force.

32. The separator of claim 31, wherein said side portion is angled approximately 10° to 12° inwardly relative to said top surface.

33. The separator of claim 31, wherein adjacent slots are separated by uniform, predetermined distances, and wherein said slots have depths approximately two to three times greater than said predetermined distances.

34. The separator of claim 31, wherein adjacent slots are separated by a distance of approximately 0.040–0.060 inches and each said slot has a depth of approximately 0.080–0.180 inches.

35. The separator of claim 31, further comprising a spider element removably attachable to said housing means, said spider element having a plurality of vanes partially extending radially downwardly from its vertical center axis into said housing means and being operable to rotate coaxially with said housing means to further enhance said separation of said dust and dirt particulates from said dust and dirt entrained air.

36. In a vacuum cleaner, a separator operable to rotate axially about its vertical axis for removing dust and dirt particulates from intake dust and dirt particulate entrained air by the application of centrifugal force to said dust and dirt particulate entrained air, said separator comprising:

annular, cup-like housing means having top, side and bottom portions, and a vertical axis, for generating said centrifugal force when said housing means is rotated axially about said vertical axis;

a plurality of elongated, vertically oriented slots in said side portion, said slots formed having upper and lower portions, said lower portions being operable to provide an intake of said dust and dirt particulate entrained air and liquid particulates from a liquid source therethrough, whereby said liquid particulates and said dust and dirt particulate entrained air coalesce inside said housing means, thereby helping facilitate separation of said dust and dirt particulates from said dust and dirt entrained air; and an annular spider element removably attachable to said housing means, said spider element having a plurality of vanes partially extending radially downwardly from its vertical center axis into said housing means and being operable to rotate coaxially with said housing means to further enhance said separation of said dust and dirt particulates from said dust and dirt entrained air;

wherein said upper portion of each said slot operates to provide an exhaust function to enable said liquid particulates coalesced with said dust and dirt particulates to be centrifugally forced therethrough, thereby leaving a relatively clean air mass within said separator.

* * * * *